US009694394B2

(12) United States Patent
Liao

(10) Patent No.: US 9,694,394 B2
(45) Date of Patent: Jul. 4, 2017

(54) ULTRASONIC CLEANSER

(71) Applicant: Minhao Tsao, New Taipei (TW)

(72) Inventor: Qi-Shuang Liao, Zhongshan (CN)

(73) Assignee: Minhao Tsao, New Taipei (TW)

( * ) Notice: Subject to any disclaimer, the term of this patent is extended or adjusted under 35 U.S.C. 154(b) by 373 days.

(21) Appl. No.: 14/617,958

(22) Filed: Feb. 10, 2015

(65) Prior Publication Data

US 2015/0223648 A1 Aug. 13, 2015

(30) Foreign Application Priority Data

Feb. 11, 2014 (CN) ..... 2014 2 0062696 U

(51) Int. Cl.

| | |
|---|---|
| ***B08B 1/00*** | (2006.01) |
| ***A47K 7/04*** | (2006.01) |
| ***B08B 7/04*** | (2006.01) |
| ***B08B 3/12*** | (2006.01) |
| *B44D 3/16* | (2006.01) |
| *B06B 3/00* | (2006.01) |

(52) U.S. Cl.

CPC ..... *B08B 1/005* (2013.01); *A47K 7/04* (2013.01); *B08B 3/12* (2013.01); *B08B 7/04* (2013.01); *B06B 3/00* (2013.01); *B44D 3/164* (2013.01)

(58) Field of Classification Search

CPC ... B08B 1/005; B08B 7/04; B08B 2203/0288; B44D 3/162; B44D 3/164; B44C 7/027

USPC ..... 15/93.1, 93.4; 30/123.3

See application file for complete search history.

(56) References Cited

U.S. PATENT DOCUMENTS

| | | | | | |
|---|---|---|---|---|---|
| 3,604,520 | A | * | 9/1971 | Shatto, Jr. | B44D 3/162 15/93.1 |
| 4,559,661 | A | * | 12/1985 | Tsals | B44D 3/164 15/93.1 |
| 4,858,264 | A | * | 8/1989 | Reinhart | A47L 13/08 15/236.1 |
| 5,839,154 | A | * | 11/1998 | Kawai | A47L 5/30 15/320 |

FOREIGN PATENT DOCUMENTS

| | | | |
|---|---|---|---|
| FR | 2758481 | * | 7/1998 |
| JP | 2008-49270 | * | 3/2008 |

* cited by examiner

*Primary Examiner* — Mark Spisich

(74) *Attorney, Agent, or Firm* — Leong C. Lei

(57) ABSTRACT

A ultrasonic cleanser includes: a housing; a ultrasonic sprayer, configured inside the housing; a ultrasonically vibrational scraper, coupled to the housing and extended out of the housing partly; a main circuit board, configured inside the housing, an output end of the main circuit board being in connection with the ultrasonic sprayer and ultrasonically vibrational scraper, and providing high frequency vibration signals; a button, configured on the housing and in electric connection with the main circuit board; and a power source, configured inside the housing, in electric connection with the main circuit board and providing power needed for the action of the main circuit board. The structure mention above combines two kinds of face cleansing manners; users may clean their faces with spray or scrape dirt on their faces by means of the physical approach with a scraper, thereby achieving a function combination and good clean effect.

5 Claims, 5 Drawing Sheets

ULTRASONIC CLEANSER

TECHNICAL FIELD OF THE INVENTION

The present invention relates to an ultrasonic cleanser, and more particularly to an ultrasonic cleanser having a function combination and good clean effect.

DESCRIPTION OF THE PRIOR ART

Traditional ultrasonic cleansers are divided functionally into two kinds: one is ultrasonic sprayers, and another is cleansers with a ultrasonically vibrational scraper. Specifically, the both have their own unique merits; they are not only clean dirt but have very good beauty features. In addition, facial blood circulation can be promoted to reach a massage health care effect because proper excitement from the ultrasonic cleansers is applied on users' faces.

But, the both kinds of the cleansers mentioned above has only their own merits, the ultrasonic sprayers are stressed on ultrasonic cleaning, while the cleansers with a scraper are adapted to scrap dirt left on face pores or a face surface through the scraper by means of a physical approach. Unfortunately, there are not cleansers suited to integrate the two manners respectively adopted by the both kinds of cleansers together currently.

SUMMARY OF THE INVENTION

To solve the disadvantage mentioned above, the present invention proposes a ultrasonic cleanser having a function combination and good clean effect.

The main object of the present invention is to provide a ultrasonic cleanser, adapted to integrate the cleansing manners of spraying and scraping by means of a physical approach together.

To achieve the object mentioned above, the present invention includes a housing, a ultrasonic sprayer, a ultrasonically vibrational scraper, a main circuit board, a button and a power source, where the ultrasonic sprayer is configured inside the housing together with a spray jet configured on the surface of the housing, and the ultrasonically vibrational scraper is coupled to the housing and part thereof is extended out of the housing. Furthermore, the circuit board is configured inside the housing, and the output end of the main circuit board is in connection with the ultrasonic sprayer and ultrasonically vibrational scraper and provides high frequency vibration signal. Furthermore, the button is configured on the housing and in electric connection with the main circuit board, where the button is adapted to control the on-off of the ultrasonic sprayer and ultrasonically vibrational scraper. In addition, the power source is configured inside the housing and in electric connection with the main circuit board to provide the power needed for the action of the main circuit board.

Through the structure mentioned above, users may use action of the ultrasonic sprayer to clean their faces with the spray or the ultrasonically vibrational scraper to scrap the dirt left on their face pores or face surfaces, or even the both manners to clean the faces one after another upon face cleansing, thereby achieving the function combination and good clean effect.

DETAILED DESCRIPTION OF THE PREFERRED EMBODIMENTS

Figure 1:
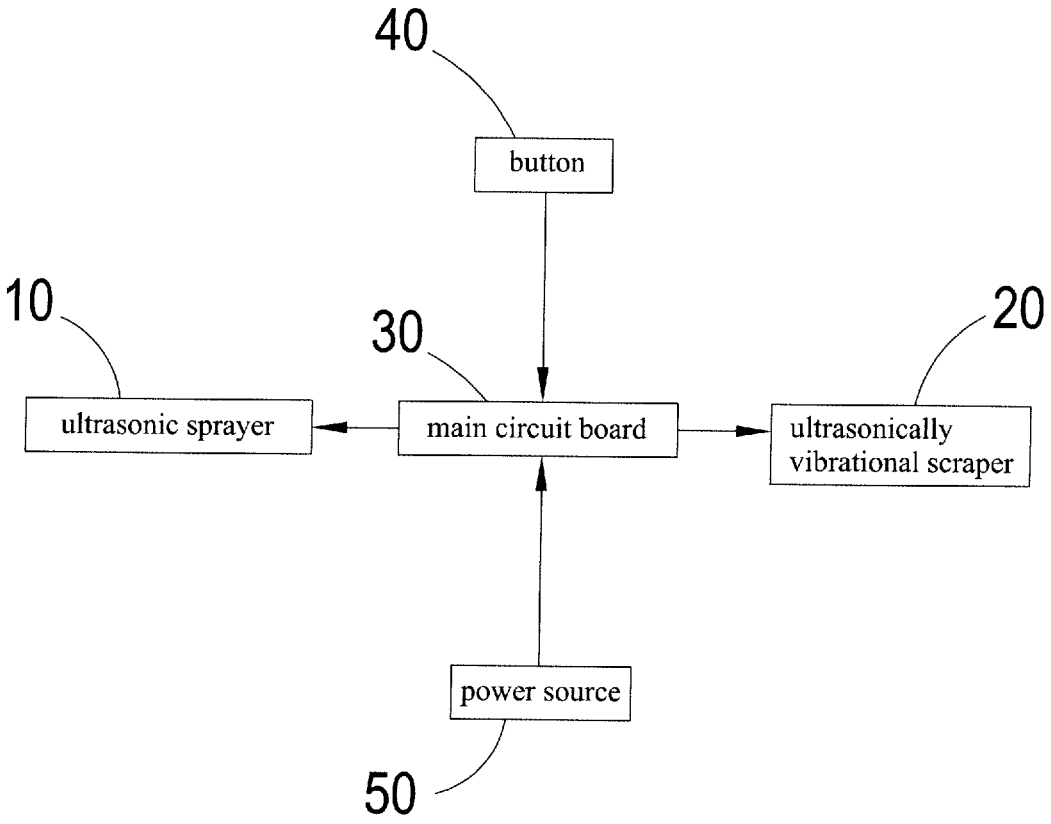
FIG. 1 is a block chart, showing a structure of a preferred embodiment according to the present invention.
Figure 2:
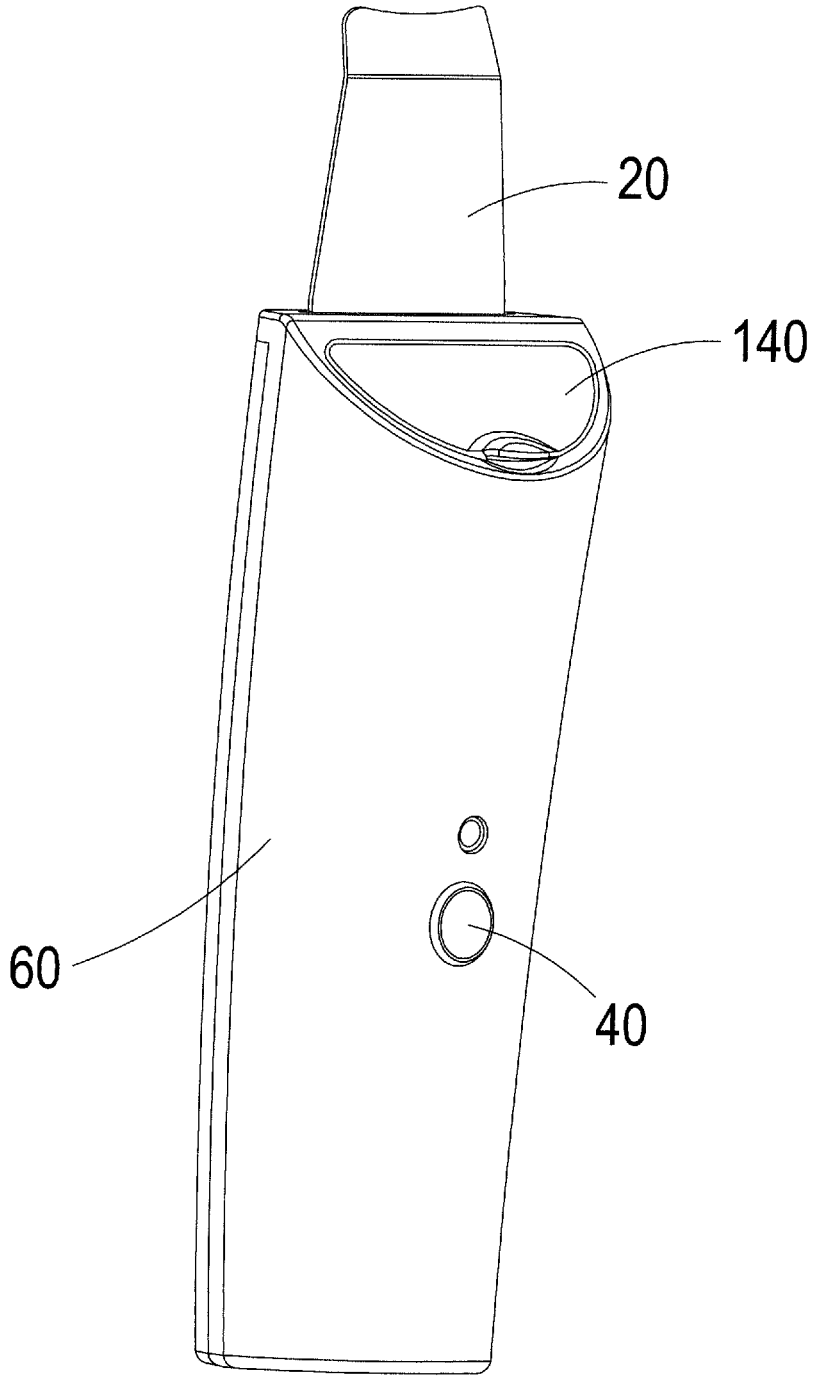
FIG. 2 is a perspective view of the embodiment according to the present invention.
Figure 3:
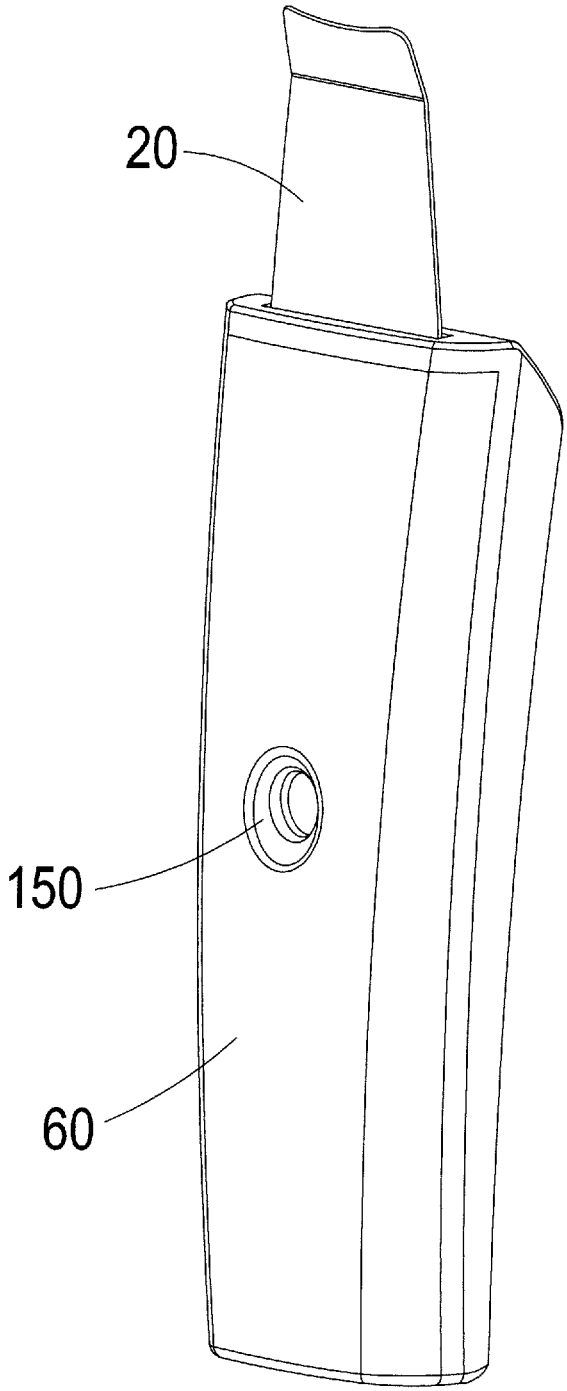
FIG. 3 is a perspective view of the embodiment of the present invention viewed from another angle.
Figure 4:
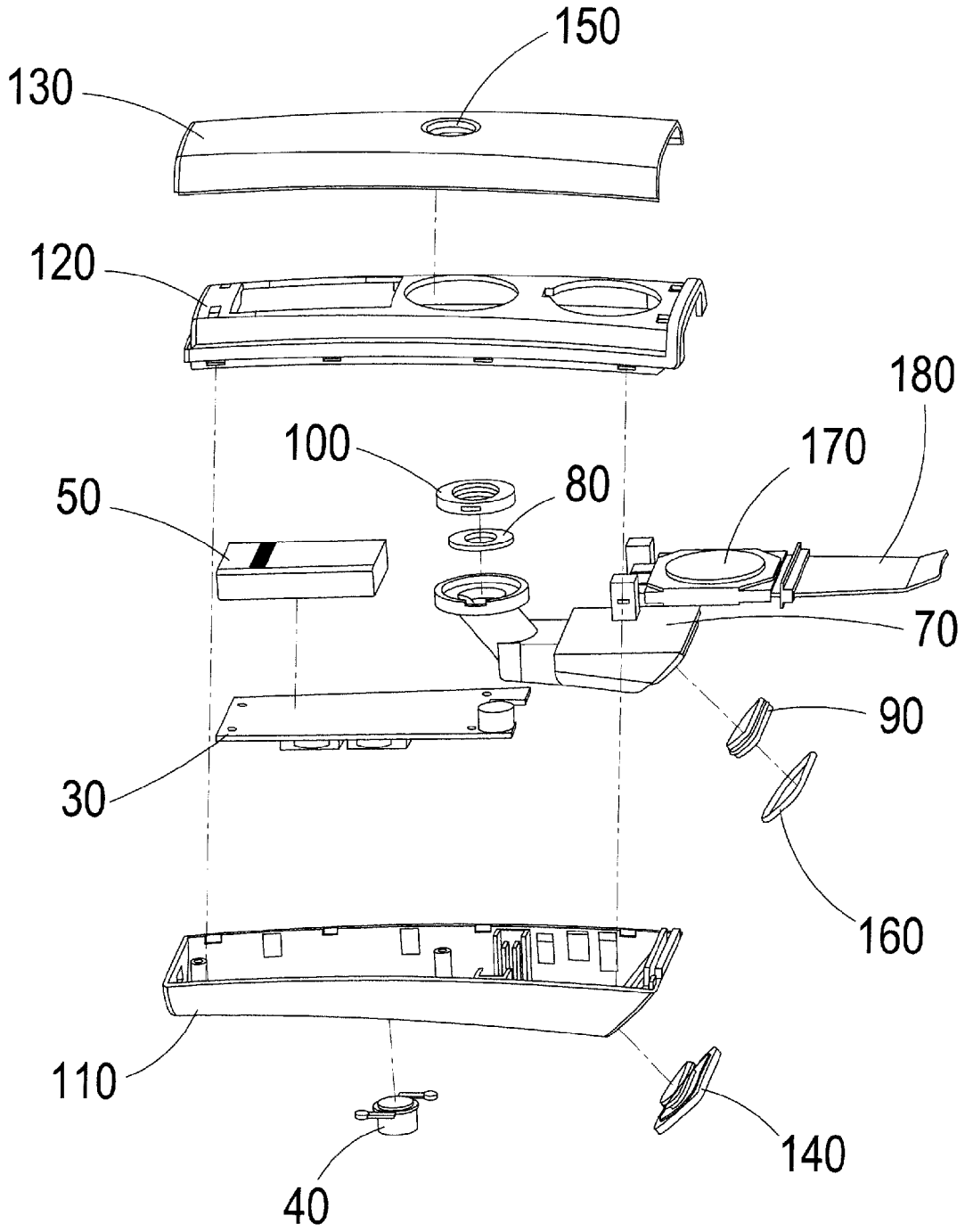
FIG. 4 is an exploded view of the embodiment according to the present invention.
Figure 5:
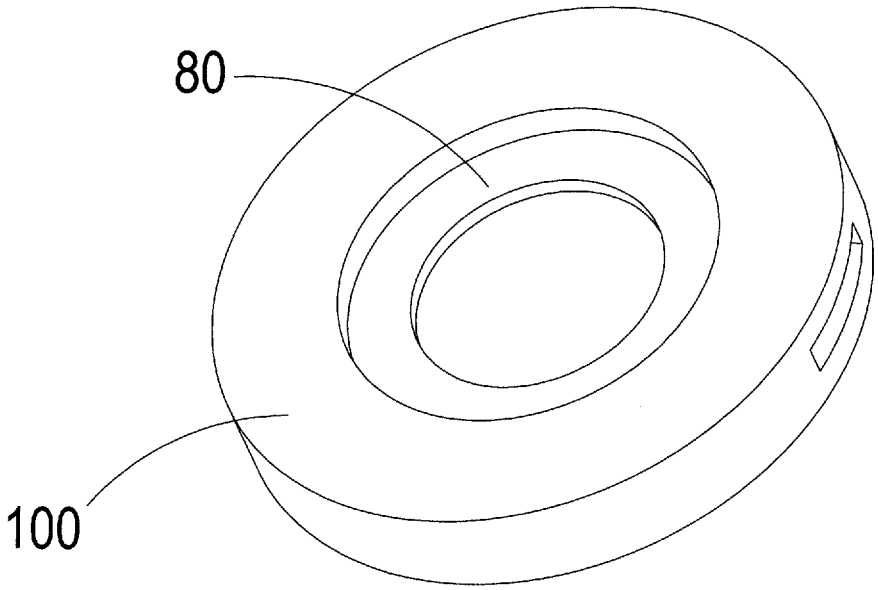
FIG. 5 is a perspective view of an atomization piece of the present invention.

Referring to FIGS. 1 to 5, which respectively are block chart, perspective view, perspective view, and exploded view of a preferred embodiment according to the present invention, and a perspective view of an atomization piece of the present invention, it is clearly seen from the figures that the present invention includes:

a housing 60;

a ultrasonic sprayer 10, configured inside the housing, an atomization jet 150 of the ultrasonic sprayer 10 being positioned on a surface of the housing 60;

a ultrasonically vibrational scraper 20, coupled to the housing 60 and extended out of the housing 60 partly;

a main circuit board 30, configured inside the housing 60, an output end of the main circuit board 30 being in connection with the ultrasonic sprayer 10 and ultrasonically vibrational scraper 20, and providing high frequency vibration signals;

a button 40, configured on the housing 60 and in electric connection with the main circuit board 30, the button 40 controlling the on-off of the ultrasonic sprayer 10 and ultrasonically vibrational scraper 20; and a power source 50, configured inside the housing 60, in electric connection with the main circuit board 30 and providing power needed for the action of the main circuit board 30.

The housing 60 accommodates a water box 70, a first sealing ring 100 adapted to strengthen a leak stoppage effect is configured on the bottom opening of the water box 70, and a sealing cover 90 is configured on the top opening of the water box 70 for the sealing thereof Furthermore, an atomization piece 80 is inlaid in the first sealing ring 100 and configured on the bottom opening, the atomization piece 80 being in electric connection with the output end of the main circuit board 30.

Furthermore, the housing 60 includes a bottom shell 110, electroplated shell 120, upper cover 130 and water box cap, where the bottom shell 110 and electroplated shell 120 constitute the inner cavity of the cleanser, the ultrasonic sprayer 10, ultrasonically vibrational scraper 20, main circuit board 30 and power source 50 are all positioned in the inner cavity and the upper cover 130 is attached to the electroplated shell 120 closely. Furthermore, a spray jet 150 corresponding to the atomization piece 80 is configured on one side of the upper cover 130, and a through hole is configured on a position at the electroplated shell 120 where the spray jet 150 corresponds to the atomization piece 80, allowing the atomized spray to be sprayed out via the through hole. The water box cap 140 is configured on an end opening configured additionally on the bottom shell 110 and corresponds to the sealing cover 90. In addition, a second sealing ring 160 is put around the sealing cover 90, and the button 40 is configured on the bottom shell 110.

Furthermore, the ultrasonically vibrational scraper 20 includes a plurality of vibrating sheets 170 configured inside the housing 60 and in electric connection with the output end of the main circuit board 30 and a blade 180 fixed to the plurality of vibrating sheets 170 and extended out of the housing 60 partly. Further, the power source 50 is a rechargeable battery, and a charging port id configured on the main circuit board, an opening being formed on a position at the housing 60 corresponding to the charging port.

From the description mentioned above, the structure of the present invention can be understood, and the advantages and characteristics of the present invention can be understood by means of the following work and principle commentaries.

In the initial state of power supplying, a first push of the button 50 is to emit a spray starting signal, and a high frequency vibration signal will be generated and transmitted to the ultrasonic sprayer 10 after the main circuit board 30 receives the spray starting signal. Thereafter, the atomization sheets 80 start generating a high frequency ultrasonic wave to atomize the liquid water in the water box 70 into spray so as to allow a user to clean the face with the spray.

After the above cleaning action is carried out for a period of time, the button 40 is pushed again (second button push) to emit a scraper vibrating signal; it means that the spray stops at the same time. Therefore, the main circuit board 30 will stop transmitting high frequency vibration signal to the ultrasonic sprayer 10 after it receives the scraper vibrating signal, transmitting, instead, the high frequency vibration signal to the vibrating sheets 170 of the ultrasonically vibrational scraper 20, and the high frequency vibration of the vibrating sheets 170 will drive the blade 180 fixed therewith to vibrate to generate ultrasonic waves, thereby allowing the blade 180 to remove the dirt on the face.

After the above scrap action is carried out for a period of time, the button 40 is pushed again (third button push) to emit a close signal, the cleanser will stop working at this time, thereby completing a work cycle; the previous two cleaning (the spray cleaning mode and vibration cleaning mode) time periods may be controlled by users themselves; simply pushing the button 40 down can then control the work time periods of the ultrasonic sprayer 10 and ultrasonically vibrational scraper 20 in the process of cleaning.

Therefore, the key point that the ultrasonic cleanser of the present invention can improve the prior arts is in that:

combing the ultrasonic sprayer 10 and ultrasonically vibrational scraper 20 together provides both face cleansing with spray and face dirt scraping by means of a physical approach, achieving the advantages of a function combination and good clean effect.

I claim:

1. A ultrasonic cleanser, comprising:

a housing;

a ultrasonic sprayer, configured inside said housing, an atomization jet of said ultrasonic sprayer being positioned on a surface of said housing;

a ultrasonically vibrational scraper, coupled to said housing and extended out of said housing partly;

a main circuit board, configured inside said housing, an output end of said main circuit board being in connection with said ultrasonic sprayer and ultrasonically vibrational scraper, and providing high frequency vibration signals;

a button, configured on said housing and in electric connection with said main circuit board, said button controlling the on-off of said ultrasonic sprayer and ultrasonically vibrational scraper; and a power source, configured inside said housing, in electric connection with said main circuit board and providing power needed for the action of said main circuit board.

2. The device according to claim 1, wherein said housing accommodates a water box, a first sealing ring adapted to strengthen a leak stoppage effect is configured on a bottom opening of said water box, a sealing cover is configured on a top opening of said water box for the sealing thereof, and an atomization piece is inlaid in said first sealing ring and configured on said bottom opening, said atomization piece being in electric connection with an output end of said main circuit board.

3. The device according to claim 2, wherein said housing comprises a bottom shell, electroplated shell, upper cover and water box cap, said bottom shell and electroplated shell constitute an inner cavity of said cleanser, said ultrasonic sprayer, ultrasonically vibrational scraper, main circuit board and power source are all positioned in said inner cavity, said upper cover is attached to said electroplated shell closely, a spray jet corresponding to said atomization piece is configured on one side of said upper cover, a through hole is configured on a position at the electroplated shell where said spray jet corresponds to said atomization piece, allowing the atomized spray to be sprayed out via said through hole, said water box cap is configured on an end opening configured additionally on said bottom shell and corresponds to said sealing cover, a second sealing ring is put around the sealing cover, and said button is configured on said bottom shell.

4. The device according to claim 1, wherein said ultrasonically vibrational scraper comprises a plurality of vibrating sheets configured inside said housing and in electric connection with an output end of said main circuit board and a blade fixed to said plurality of vibrating sheets and extended out of said housing partly.

5. The device according to claim 1, wherein said power source is a rechargeable battery, said main circuit board is configured with a charging port, and an opening is formed on a place at said housing corresponding to said charging port.

* * * * *